United States Patent [19]

Ohkumo

[11] Patent Number: 5,076,230

[45] Date of Patent: Dec. 31, 1991

[54] IDLE SPEED CONTROL SYSTEM FOR AN ENGINE

[75] Inventor: Hiroya Ohkumo, Musashino, Japan

[73] Assignee: Fuji Jukogyo Kabushiki Kaisha, Tokyo, Japan

[21] Appl. No.: 580,633

[22] Filed: Sep. 7, 1990

[30] Foreign Application Priority Data

Sep. 29, 1989 [JP] Japan ..... 1-254756

[51] Int. Cl.[5] ..... F02M 3/00

[52] U.S. Cl. ..... 123/339

[58] Field of Search ..... 123/339, 585, 340

[56] References Cited

U.S. PATENT DOCUMENTS

| | | | |
|---|---|---|---|
| 4,474,151 | 10/1984 | Atago et al. | 123/339 |
| 4,526,144 | 7/1985 | Hasegawa et al. | 123/339 |
| 4,651,694 | 3/1987 | Kataoka | 123/339 |
| 4,825,829 | 5/1989 | Abe | 123/339 |
| 4,903,658 | 2/1990 | Miyama et al. | 123/339 |
| 4,969,435 | 11/1990 | Morikawa et al. | 123/339 |
| 4,989,565 | 2/1991 | Shimomura et al. | 123/339 |

FOREIGN PATENT DOCUMENTS

| | | | |
|---|---|---|---|
| 59-226250 | 12/1984 | Japan | 123/339 |

*Primary Examiner*—Raymond A. Nelli
*Attorney, Agent, or Firm*—Martin A. Farber

[57] ABSTRACT

A feedback control system has a comparing section to compare idling engine speed with a wide dead zone and a narrow dead zone. The wide dead zone has a predetermined width with respect to a desired idle speed. The narrow dead zone width is narrower than the wide dead zone width. When the idling speed is out of the wide dead zone, the system selects the narrow dead zone for rapid convergence of the idling speed. When the idling speed is within the narrow dead zone, the system selects the wide dead zone to prevent hunting.

5 Claims, 3 Drawing Sheets

IDLE SPEED CONTROL SYSTEM FOR AN ENGINE

BACKGROUND OF THE INVENTION

The present invention relates to a system for controlling idle speed of an automotive engine through a feedback control operation for causing the actual idle speed to converge to a desired idle speed.

In an idle speed control system, a bypass having an idle speed control valve (ISCV) is provided around a throttle valve of the engine. The idle speed control valve is operated to control the amount of intake air for causing the actual idle speed to converge to the desired idle speed by a feedback control system.

In the feedback control system, a dead zone is provided with respect to the desired idle speed in order to prevent the opening degree of the ISCV from hunting when the idle speed approximates the desired idle speed. When the engine speed is within the dead zone, the feedback operation is stopped so that the opening degree of the ISCV is held constant Hence, the convergence of the idle speed is improved.

Japanese Patent Application Laid-Open 59-226250 discloses such an idle control system where the feedback operation is carried out only in a transient state, such as the time when an air-conditioner is started and stopped, which causes fluctuation of the idle speed.

In the feedback control operation, a dead zone is provided.

In a no load state, the engine speed is controlled by an open-loop control. Accordingly, there are disadvantages in that the idle speed can fluctuate without converging to a desired speed.

Furthermore, the width of the dead zone is obtained by adding a predetermined value to the average of the differences of peak engine speeds at the time of fluctuation. Since the width of the dead zone changes with the fluctuation of the engine speed, it is difficult for the engine speed to accurately converge to the desired idle speed. More particularly, the width of the dead zone for the desired idle speed (for example 800 rpm) is set at a value (for example ±50 rpm) which is slightly larger than the fluctuating width of the engine speed. Thus, an undesirable feedback operation caused by the fluctuation of the engine speed is avoided. However, since the dead zone is wide (750–850 rpm), the range of the controlled engine idling speed becomes large. To the contrary, if the dead zone is reduced, the ISCV is operated even if a slight fluctuation of the engine speed occurs. As a result, the idling speed fluctuates.

SUMMARY OF THE INVENTION

The object of the present invention is to provide an idle speed control system for an automotive engine where the engine speed is accurately converged to a desired idle speed while preventing the hunting of the control system.

According to the present invention, there is provided a system for controlling idling speed of an engine, the system having an engine speed sensor for detecting engine speed, an idle speed control valve for controlling air flow quantity for said engine during idling, an actuator for operating said idle speed control valve so as to control said idling speed, and a control unit for comparing said engine speed with a desired idle speed for controlling said idling speed through a feedback operation, wherein the control unit comprises: dead zone width providing means for providing a first width and a second width which is wider than said first width; and comparator means comprising: means for defining a first dead zone with said first width with respect to said desired idle speed, and further for defining a second dead zone with said second width with respect to said desired idle speed, and each dead zone having an upper limit value and a lower limit value respectively; selecting means for selecting either of said first width and said second width in accordance with said engine speed; and first comparing means for comparing said engine speed with said upper limit value and lower limit value of the dead zone corresponding to the selected width for producing a control signal to actuate said actuator for decreasing said idling speed when said engine speed is larger than said upper limit value of said dead zone corresponding to the selected width, and for producing a control signal to actuate said actuator for increasing said idling speed when said engine speed is smaller than said lower limit value of said dead zone corresponding to the selected width so as to accurately converge said idling speed to said desired idle speed and prevent hunting of said idling speed.

The other objects and features of this invention will be apparently understood from the following description with reference to the accompanying drawings.

DETAILED DESCRIPTION OF THE PREFERRED EMBODIMENT

Figure 1:
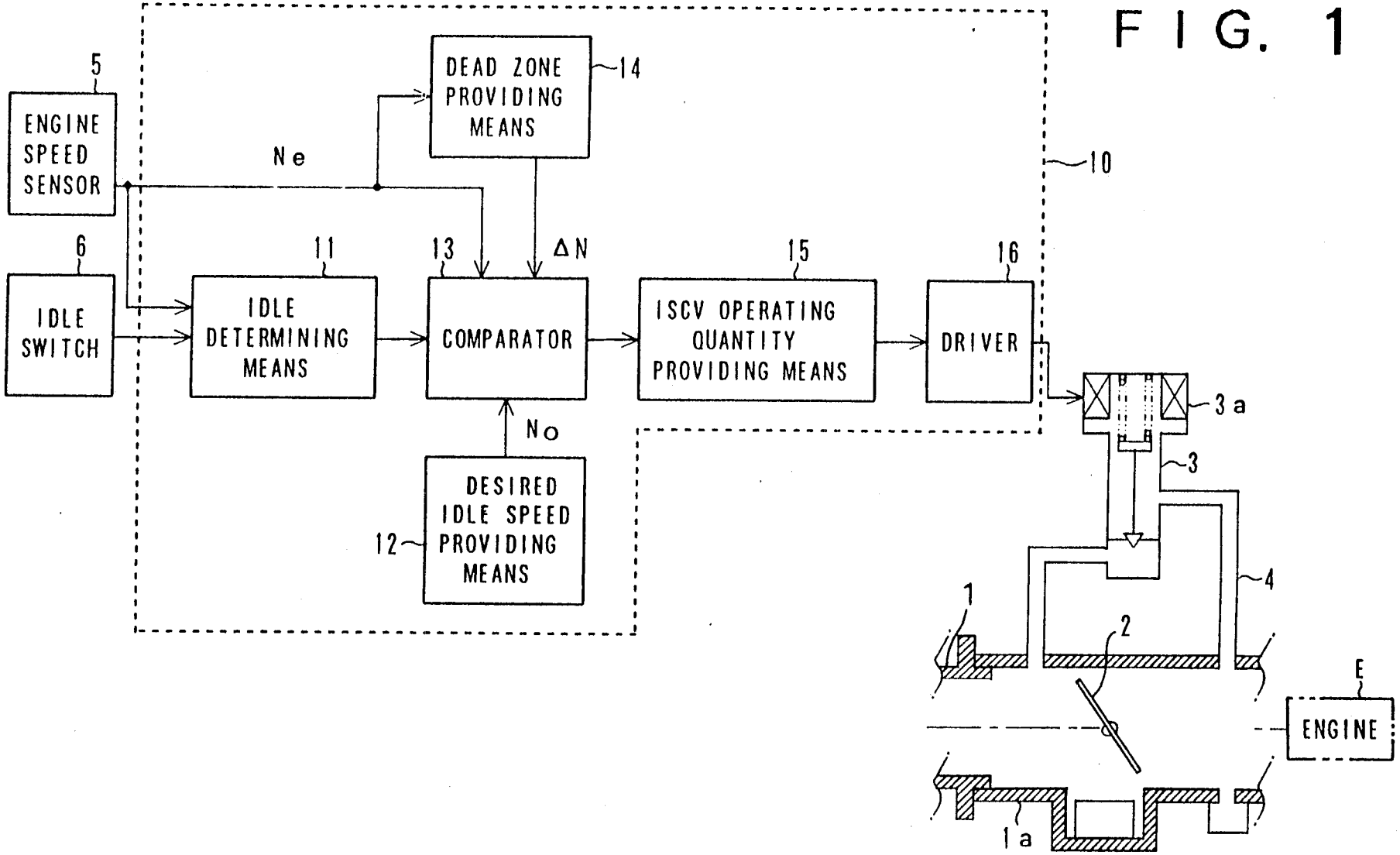
FIG. 1 is a schematic illustration showing a system of the present invention and a block diagram of a control unit used in the system.

Referring to FIG. 1, an automotive engine E has an intake pipe 1 and a throttle body 1*a* connected to the intake pipe 1 and provided with a throttle valve 2. A solenoid-operated idle speed control valve (ISCV) 3 is provided in a bypass 4. A solenoid 3*a* of the ISCV 3 is applied with a control signal from a control unit 10 in a control system of the present invention.

The control system has an engine speed sensor 5 and an idle switch 6 which is closed when the throttle valve 2 is closed. Engine speed Ne from the engine speed sensor 5 and the output signal of the idle switch 6 are fed to idle determining means 11 which produces an idle signal when the idle switch 6 is closed while the engine speed is smaller than a predetermined reference speed. A desired idle speed No is provided in a desired idle speed providing means 12.

Figure 2:
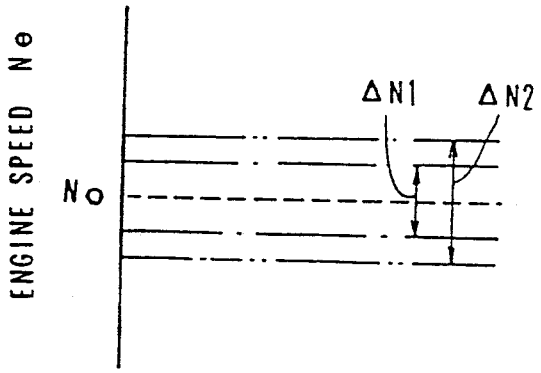
FIG. 2 is a graph showing dead zones in a feedback control system.

The control unit further has a comparator means 13 and a dead zone width providing means 14. The engine speed Ne is fed to the dead zone width providing means 14 for determining a width ΔN of a dead zone. As shown in FIG. 2, a narrow dead zone width ΔN1, for example, 50 rpm (±25 rpm) and a wide dead zone width ΔN2, for example 100 rpm (±50 rpm), are provided in the dead zone width providing means 14.

The dead zone widths ΔN1, and ΔN2, the engine speed Ne and the desired idle speed No are fed to the comparator means 13. In the comparator means, the engine speed Ne is compared with the desired idle speed in three comparing zones in conjunction with the narrow and wide dead zone widths ΔN1 and ΔN2. More particularly, the comparator means has first comparing means and second comparing means. The second comparing means determines one of the following three zones, in which the engine speed falls.

$$Ne > No + \Delta N2/2 \quad (1)$$

$$No + \Delta N1/2 \geqq Ne \geqq No - \Delta N1/2 \quad (2)$$

$$Ne < No - \Delta N2/2 \quad (3)$$

In other words, in the zone (1), the engine speed is larger than an upper limit of a wide reference zone which is determined by the wide dead zone width ΔN2 and the desired idle speed No. In the zone (3), the engine speed is smaller than a lower limit of the wide reference zone. In the zone (2), the engine speed is within a narrow reference zone which is determined by the narrow dead zone width ΔN1 and the desired idle speed No. When the engine speed Ne is in the zone (1), where the engine speed is too large for idling, or in the zone (3) where the engine speed is too small, the narrow dead zone width ΔN1 is selected as the dead zone width ΔN in order to cause the engine speed Ne to precisely converge to the desired idle speed No. When the engine speed Ne is in the zone (2), the wide dead zone width ΔN2 is selected, thereby preventing hunting of the engine speed.

In the first comparing means, the engine speed Ne is compared with the upper limit and the lower limit of the wide reference zone. When the engine speed exceeds the upper limit ($Ne > No + \Delta N2/2$), an ISCV opening degree decreasing signal is fed to ISCV operating quantity providing means 15. If the engine speed is smaller than the lower limit ($Ne < No - \Delta N2/2$), an ISCV opening degree increasing signal is fed to the ISCV operating quantity providing means 15. The ISCV operating quantity providing means 15 provides a predetermined ISCV operating quantity or a quantity based on the difference between the actual engine speed Ne and the desired idle speed No when the ISCV opening degree changing signal is applied. A driver 16 which is fed with the operating quantity applies pulses, the duty ratio of which corresponds to the operating quantity, to the solenoid 3*a* of the ISCV 3.

The operation of the control system of the present invention is described hereinafter with reference to the flowchart and the timechart shown in FIGS. 3 and 4, respectively.

Figure 3:
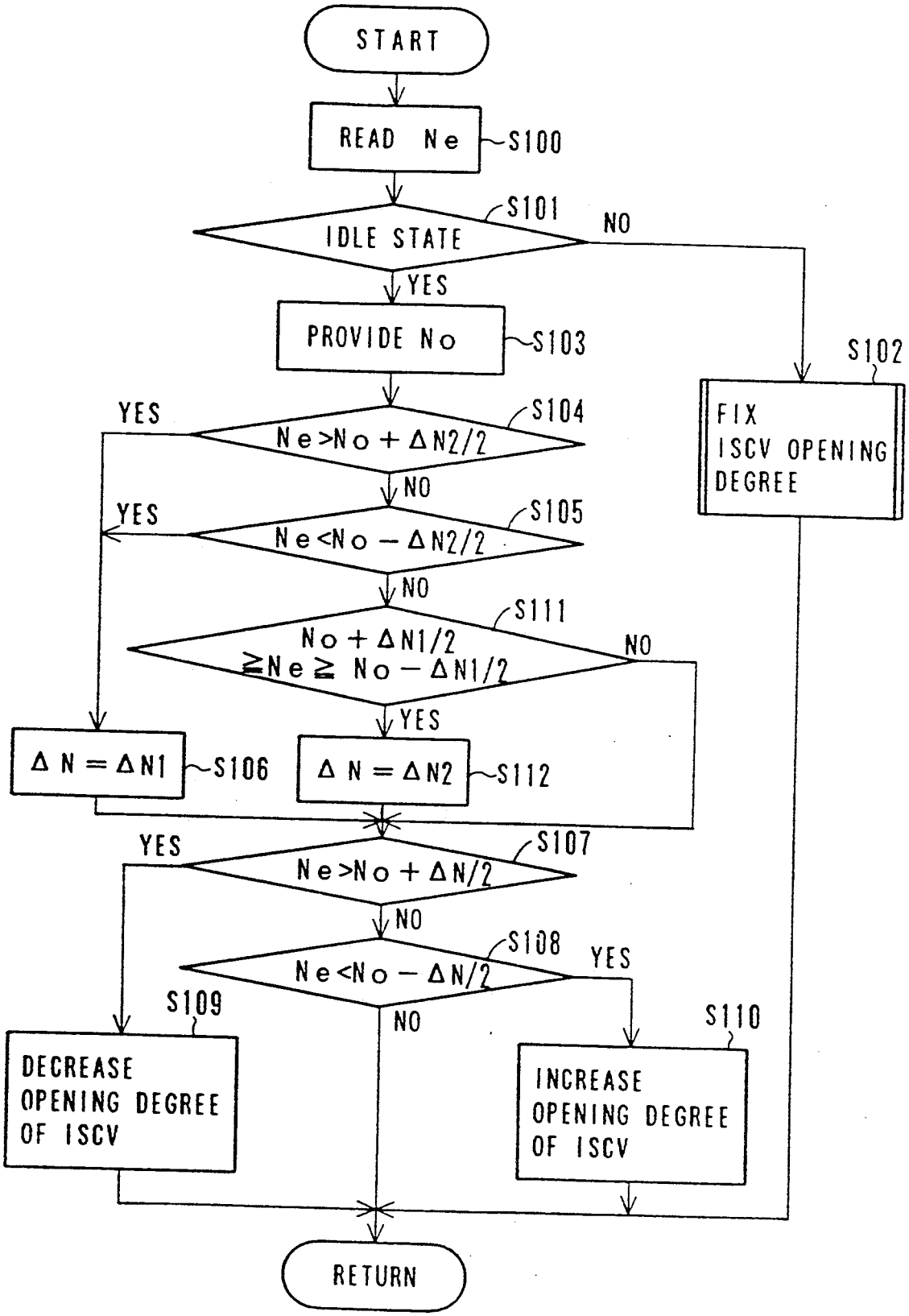
FIG. 3 is a flowchart showing the operation of the system of the present invention.

Referring to FIG. 3, at a step S100, the engine speed Ne is read out, and at a step S101, it is determined whether the engine is idling or not in accordance with the output signal of the idle switch 6. When the engine is not idling, the program goes to a step S102, where the opening degree of the ISCV 3 is maintained at a predetermined degree.

On the other hand, in the idle state, the desired idle speed No is provided at a step S103. At steps S104 and S105, the engine speed Ne is checked. When the engine speed Ne is excessively larger or smaller than the desired idle speed No, that is, in zone (1) ($Ne > \Delta No + \Delta N2/2$) or zone (3) ($Ne < No - \Delta N2/2$), the program goes to a step S106. At the step S106, the narrow dead zone width ΔN1 is chosen as the dead zone width ΔN. At a step S107, the engine speed Ne is compared with the upper engine speed Limit $No + \Delta N/2$ of the narrow reference zone. When the engine speed Ne is larger than the upper limit, the program goes to a step S109 where the opening degree of the ISCV 3 is reduced. When the engine speed Ne is smaller than the upper limit, it is determined at a step S108 whether the engine speed Ne is lower than the lower limit $No - \Delta N/2$. When the engine speed is smaller than the lower limit, the program goes to a step S110 where the opening degree of the ISCV 3 is increased. If the engine speed is between the limits $No + \Delta N/2$ and $No - \Delta N/2$, the opening degree of the ISCV 3 is maintained.

Figure 4:
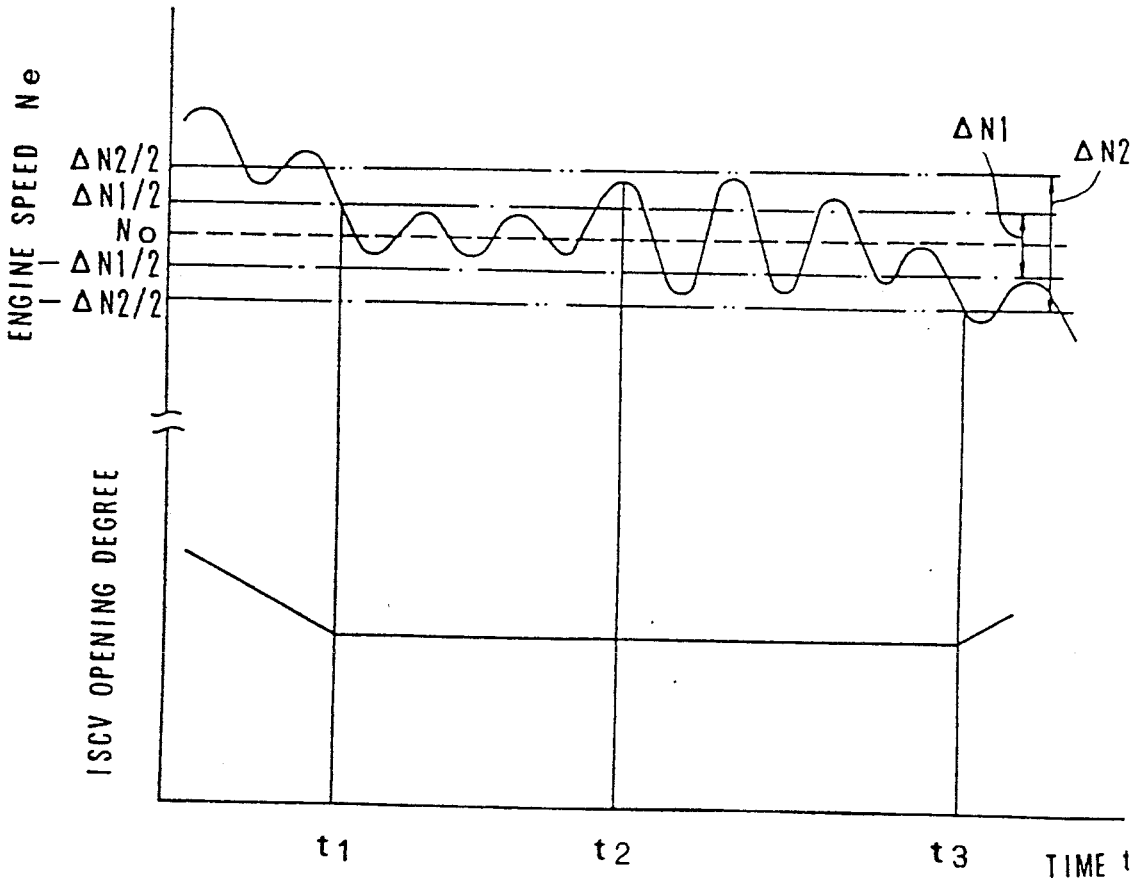
FIG. 4 is a timechart showing variations of the engine speed and ISCV opening degree in accordance with the present invention.

Referring to FIG. 4, before a time t1 the engine speed Ne is in the zone (1), so that the dead zone width ΔN1 is selected The program goes from the step S107 to the step S109, thereby decreasing the opening degree of the ISCV 3. As a result, the quantity of intake air supplied to the engine E is decreased so as to reduce the engine speed Ne accordingly. The opening degree of the ISCV 3 is gradually decreased until the engine speed Ne becomes smaller than the upper limit $No + \Delta N1/2$ of the narrow dead zone. Thereafter, the opening degree of the ISCV 3 is maintained so that the average engine speed approximates the desired idle speed No.

As a consequence, the engine speed Ne is in neither of the zones (1) or (3) so that the program proceeds from the step S105 to a step S111 where it is determined whether the engine speed Ne is in the zone (2) ($No + \Delta N1/2 \geqq Ne \geqq No - \Delta N1/2$). When the engine speed is in the zone (2), the wide dead zone width ΔN2 is selected as the dead zone width ΔN at a step S112. Thereafter, the program proceeds to the step S107. Thus, even though the engine speed Ne largely fluctuates over the narrow dead zone at a time t2 in FIG. 4, since the engine speed Ne is still smaller than the upper limit $No + \Delta N2/2$ of the wide dead zone, the ISCV 3 is kept unchanged, hence preventing hunting.

When the engine speed Ne becomes smaller than the lower limit $No - \Delta N2/2$, at a time t3 in FIG. 4, the program proceeds from the step S105 to the step S106 so that the narrow width ΔN1 is again selected. The program goes from the step S108 to the step S110 where the opening degree of the ISCV 3 is increased. The quantity of the intake air increases accordingly to raise the engine speed Ne. When the engine speed Ne increases to $No - \Delta N1/2$, the opening degree of the ISCV 3 is no longer increased. Thus, the average engine speed converges to the desired idle speed No without causing hunting.

The present invention may be so modified to correct the desired idle speed at a cold engine state.

In accordance with the present invention, the narrow dead zone and the wide dead zone are provided. The feedback operation is performed by using the narrow dead zone when the engine speed is extremely large or small. Thus, the engine speed accurately converges to the desired idle speed. Once the engine speed approximates the desired idle speed, the wide dead zone is used so as to effectively prevent hunting. Selection of the narrow dead zone or the wide dead zone is determined in accordance with the comparison of the actual engine speed with the upper and lower limits so that the control operation becomes simple.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In a system for controlling idling speed of an engine, the system having an engine speed sensor for detecting engine speed, an idle speed control valve for controlling air flow quantity for said engine during idling, an actuator for operating said idle speed control valve so as to control said idling speed, and a control unit for comparing said engine speed with a desired idle speed for controlling via said actuator said idling speed through a feedback operation, the improvement wherein the control unit comprises:

dead zone width providing means for providing a first width and a second width which is wider than said first width; and comparator means comprising:

means for defining a first dead zone with said first width with respect to said desired idle speed, and further for defining a second dead zone with said second width with respect to said desired idle speed, and each dead zone having an upper limit value and a lower limit value respectively;

selecting means for selecting either of said first width and said second width in accordance with said engine speed;

first comparing means for comparing said engine speed with said upper limit value and lower limit value of the dead zone corresponding to the selected width, for producing a control signal to actuate said actuator for decreasing said idling speed when said engine speed is larger than said upper limit value of said dead zone corresponding to the selected width, and for producing a control signal to actuate said actuator for increasing said idling speed when said engine speed is smaller than said lower limit value of said dead zone corresponding to the selected width so as to accurately converge said idling speed to said desired idle speed and prevent hunting of said idling speed.

2. The system according to claim 1, wherein the control unit further comprises second comparing means for comprising said engine speed with said upper and lower limit values of said first and second dead zones respectively, for producing another signal when said engine speed is larger than said upper limit value of said second dead zone; and said selecting means responsive to said another signal for selecting said first dead zone.

3. The system according to claim 1, wherein the control unit further comprises second comparing means for comparing said engine speed with said upper and lower limit values of said first and second dead zones respectively, for producing a zone signal; and said selecting means being responsive to said zone signal for selecting said first dead zone.

4. The system according to claim 1, wherein the control unit further comprises second comparing means for comparing said engine speed with said upper and lower limit values of said first and second dead zones, for producing a zone signal when said engine speed is within said first dead zone; and said selecting means being responsive to said zone signal for selecting said second dead zone.

5. A method for controlling idling speed of an engine by controlling an idle speed control valve controlling air flow quantity for said engine during idling, comprising the steps of a) providing a first width in rpm and a second width in rpm wider than said first width, b) repeatedly determining if the engine speed is outside of said second width about a desired idle speed, c) selecting said first width when the determination of step b) is outside of said second width about said desired idle speed, d) determining if the engine speed is outside of a selected of said widths about said desired idle speed, e) decreasing or increasing opening degree of said idle speed control valve, when the determination of step d) with said selected first width is outside of said first width about said desired idle speed, in a direction to cause the engine speed to converge toward said desired idle speed, f) determining if said engine speed is within said first width about said desired idle speed when the determination of step b) is within said second width about said desired idle speed, g) selecting said second width when the determination of step f) is that said engine speed is within said first width about said desired idle speed, h) performing step d) with the selected second width when the last selection was said second width, and when the answer to this determination of step d) is within said second width about said desired idle speed maintaining the opening degree of said idle speed control valve thereby preventing hunting, and i) performing step d) with the selected first width when the last selection was said first width, and when the answer to step f) is that said engine speed is outside said first width about said desired idle speed, performing step e).

* * * * *